United States Patent [19]

Williamson

[11] Patent Number: 4,941,330

[45] Date of Patent: Jul. 17, 1990

[54] MULTI-STAGE FLASH EVAPORATOR

[76] Inventor: William R. Williamson, 8310 Pilgrim Rd., Pensacola, Fla. 32504

[21] Appl. No.: 134,318

[22] Filed: Dec. 17, 1987

Related U.S. Application Data

[60] Division of Ser. No. 732,861, May 10, 1985, Pat. No. 4,731,164, which is a continuation-in-part of Ser. No. 617,760, Jun. 6, 1984, Pat. No. 4,548,257, which is a continuation of Ser. No. 350,804, Feb. 22, 1982, abandoned.

[51] Int. Cl.[5] ..... F25B 39/02

[52] U.S. Cl. ..... 62/515; 165/158

[58] Field of Search ..... 165/113, 142, 158, 908, 165/905; 202/173; 159/6.1; 62/52, 515, 467

[56] References Cited

U.S. PATENT DOCUMENTS

| | | | |
|---|---|---|---|
| 1,574,675 | 2/1926 | McKean et al. | 165/142 |
| 2,243,593 | 5/1941 | Zallea | 165/142 |
| 2,549,687 | 4/1951 | Jack et al. | 165/156 |
| 2,800,307 | 7/1957 | Putney | 159/601 |
| 2,994,647 | 8/1961 | Williamson et al. | 159/6.1 |
| 3,059,396 | 10/1962 | Thees | 165/113 |
| 3,142,381 | 7/1964 | Ris et al. | 202/173 |
| 3,155,600 | 11/1964 | Williamson et al. | 202/173 |
| 3,181,606 | 5/1965 | Williamson et al. | 202/173 |
| 3,186,924 | 6/1965 | Belanger | 165/158 |
| 3,285,832 | 11/1966 | Sephton | 202/173 |
| 3,312,601 | 4/1967 | Wilson et al. | 159/18 |
| 3,361,649 | 1/1968 | Karter | 203/40 |
| 3,423,294 | 1/1969 | Sephton | 159/18 |
| 3,533,267 | 10/1970 | Bunnell | 72/299 |
| 3,580,816 | 5/1971 | Tidball et al. | 202/173 |
| 3,681,936 | 8/1972 | Park | 165/156 |
| 4,140,584 | 2/1979 | Margen | 203/86 |
| 4,142,580 | 3/1979 | Bailey | 165/142 |

FOREIGN PATENT DOCUMENTS

| | | | |
|---|---|---|---|
| 122563 | of 1919 | United Kingdom | 165/135 |

OTHER PUBLICATIONS

Williamson et al.: a Heat Pump Distiller/Concentrator, May, 1984.

*Primary Examiner*—Ronald C. Capossela
*Attorney, Agent, or Firm*—George A. Bode

[57] ABSTRACT

A multi-flash evaporator having modular vertical cyclone chambers designed to generate a paraboloid of revolution providing an extended surface area for release of flashed vapors and attaining equilibrium. With multiple stages, the system incorporates deep loop seals to prevent blowby between stages at all levels of capacity and employs a vapor lift system to permit low pressure differentials between stages at high vacuum. The cyclone chambers employ an intermediate tangential inlet whereby the flashing vapors propel the liquid at higher velocities to generate a deeper paraboloid of revolution and centrifugally separate the heavier liquid from the flashing vapor. An anti-creep ring is interdisposed at the top of the cyclone to prevent the liquid from entering a mesh so only vapor impinges on the mesh and passes to the heat recovery condensers embodying a bayonet augmented tube heat exchanger.

4 Claims, 7 Drawing Sheets

MULTI-STAGE FLASH EVAPORATOR

BACKGROUND OF THE INVENTION

This application is division of application Ser. No. 06/732,861, filed May 10, 1985 now U.S. Pat. No. 4,731,164 which is a continuation-in-part application of Ser. No. 617,760 filed June 6, 1984, now U.S. Pat. No. 4,548,257, a continuation of Ser. No. 350,604 filed Feb. 22, 1982 and now abandoned. The specification, including the claims, and the drawings of these prior applications are included herein, as if fully set out below, as part of the specification by reference.

1. Field of the Invention

The present invention relates to flash distillation in a multi-stage flash evaporator in a liquid-vapor equilibrium that prevents blow by between stages. The present invention more particularly relates to a multi-flash system having a plurality of serially connected modular vertical cyclone chambers each designed to generate a paraboloid of revolution thus providing an extended surface area for release of flashed vapors and attaining equilibrium. With multiple stages, the system provides means for preventing blowby between stages employs a vapor lift system to permit low pressure differentials between stages at high vacuum.

2. General Background

Many types of flash chambers and control devices have been employed in the development of flash distillation. Recent efforts have been directed to attaining liquid-vapor equilibrium and preventing blowby between stages.

Different patents are directed to attaining equilibrium and include:

U.S. Pat. No. 2,908,618 entitled "Flash-Type Distillation System" issued to H. E. Bethon and assigned to the U.S. Navy using loop seals;

Applicant's U.S. Pat. No. 2,994,647 entitled "Flash Evaporator" assigned to AMF Co., Inc. employs a submerged bottom tangential inlet to introduce fluid at a high flow rate to a cyclone to produce a generally parabolic surface and spilling over at the top of an inner cylinder;

U.S. Pat. No. 3,360,442 entitled "Multi-Stage Flash Evaporator" issued to R. Starmer employs an orifice;

Applicant's U.S. Pat. No. 3,418,213 entitled "Multi-Stage Evaporator With Evaginated Venturi Inlet For Each Stage" employs an evaginated venturi; and U.S. Pat. No. 3,336,966 entitled "Flow Control Means For Multi-Stage Flash Evaporators" issued to R. W. Goeldner and discloses five (5) different mechanical contrivances in an attempt to solve this problem.

Other patents which are directed to flash distillation and attempting to attain liquid-vapor equilibrium and prevent blowby between stages include:

U.S. Pat. No. 2,613,177 entitled "Low-Pressure Flash Evaporator" issued to E. P. Worthen, et al. and assigned to Bethlehem Steel Company;

U.S. Pat. No. 2,934,477 entitled "Flash-Type Distillation System" issued to R. E. Siegfried and assigned to Badger Manufacturing Company;

U.S. Pat. No. 2,959,524 (Re. No. 25,232) entitled "Plural Stage Flash Evaporation Method" issued to R. W. Goeldner and assigned to Cleaver-Brooks Co.;

U.S. Pat. No. 3,161,558 entitled "Flash Chamber Structure" issued to Pavelic & Goeldner and assigned to Aqua Chem, Inc.;

U.S. Pat. No. 3,172,824 entitled "Evaporator Construction" issued to S. F. Mulford and assigned to B.L.H. Corp.;

U.S. Pat. No. 3,174,914 entitled "Tandem Flash Distilling Plant" issued to E. P. Worthen, et al. and assigned to Bethlehem Steel Company;

U.S. Pat. No. 3,186,924 entitled "Flash Evaporator" issued to Applicant, et al. and assigned to AMF Co. Inc.;

U.S. Pat. No. 3,192,132 entitled "Apparatus For Conducting Feed Through Flash Evaporators" issued to F. A. Loebel and assigned to Aqua Chem, Inc.;

U.S. Pat. No. 3,197,387 entitled "Multi-Stage Flash Evaporators" issued to H. R. Lawrance and assigned to B.L.H. Corp.;

U.S. Pat. No. 3,219,553 entitled "Multi-Stage Flash Type Evaporators" issued to C. M. Hughes and assigned to AMF Co., Inc.; and U.S. Pat. No. 3,281,334 entitled "Multistage Evaporator Constructor" issued to Applicant and assigned to AMF Co., Inc.

Articles directed to this problem include "Heat Pump Distiller/Concentrator" co-authored by the Applicant, John W. Spielman and Rodney C. Williamson and published in the Water Supply Improvement Association (WSIA) 12th Annual Conference Technical Proceedings Vol. I, Sessions I–VI May 13–18, 1985 at Orlando, Fla. This publication is incorporated herein by reference.

3. General Discussion of the Present Invention

The Applicant has found that the cyclone of his U.S. Pat. No. 2,994,647 can be best generated by a tangential inlet placed in the mid-section of the flash chamber whereby the flashing vapors propel the liquid at higher velocities to generate a deeper paraboloid of revolution and centrifugally separate the heavier liquid from the flashing vapor. An anti-creep ring is interdisposed at the top of the cyclone to prevent the liquid from entering a mesh so that only fog particles impinge on the mesh and coalesce in the manner described by many different types of "mist eliminators" as the vapor passes to a heat recovery condenser. This simple arrangement effectively solves the equilibrium problem in a cost effective way as will be illustrated further herein in describing the structure of the apparatus of the present invention and its methods of application. The modular vertical cyclone arrangement of the present invention permits the use of deep loop seals to prevent blowby between stages in addition to allowing a "vapor lift" action to reduce the minimum pressure differential required between stages. The apparatus of the present invention provides a low pressure gradient between stages permitting the use of more stages which greatly increases the coefficient of performance as demonstrated by Worthen's U.S. Pat. No. 2,613,177 which covers two (2) stages; Siegfried's U.S. Pat. No. 2,934,477 which covers four (4) stages; Bethon's U.S. Pat. No. 2,908,618 disclosing six (6) stages; and Applicant's U.S. Pat. No. 2,994,647 which discloses eight (8) or more stages. The modular vertical cyclone arrangement of the present invention allows a stepdown gravitational assist for squeezing in additional stages at the bottom end and employs the cost effective use of the "Bayonet Tube Heat Exchanger" of Applicant's co-pending application, Ser. No. 617,760, now U.S. Pat. No. 4,548,257, for a more efficient condensing arrangement. Disclosure of methods of application will illustrate the versatility of this invention.

The general object of the present invention is to provide a multi-stage flash evaporator which can be used in water distillation with greater efficiency than other flash evaporators and to produce a more pure distillate at a higher capacity.

It is further the object of the present invention to provide a flash evaporator having an intermediate tangential inlet whereby flashing vapors propel the liquid at higher velocities to generate a deeper paraboloid of revolution and centrifugally separate heavier liquids from the flashing vapor.

It is further the object of the present invention to provide an anti-creep ring interdisposed at the top of the cyclone to prevent the liquid from entering a mesh so that only fog particles impinge on the mesh and coalesce to eliminate the mist.

It is further the object of the present invention to provide a liquid-vapor equilibrium and prevent blowby between stages in a multi-stage flash evaporator in a cost effective manner.

It is further the object of the present invention to provide modular vertical cyclone chamber to allow the use of deep loop seals to prevent blowby between stages in a multi-stage flash evaporator.

It is further the object of the present invention to provide modular vertical cyclones in a multi-stage flash evaporator to allow a "vapor lift" action to reduce the minimum pressure differential required between stages.

It is further the object of the present invention to provide a multi-stage flash evaporator having a low pressure gradient between stages to permit the use of more stages to greatly increase the coefficient of performance.

It is further the object of the present invention to provide modular vertical cyclones in a multi-stage flash evaporator to allow a stepdown gravitational assist for squeezing in additional stages at the bottom end.

It is further the object of the present invention to employ a bayonet tube heat exchanger in a multi-stage flash evaporator to provide an efficient condensing arrangement.

BRIEF DESCRIPTION OF THE DRAWINGS

For a further understanding of the nature and objects of the present invention, reference should be had to the following detailed description, taken in conjunction with the accompanying drawings, in which like parts are given like reference numerals, and, wherein.

DETAILED DESCRIPTION OF THE PREFERRED EMBODIMENT

Figure 1:
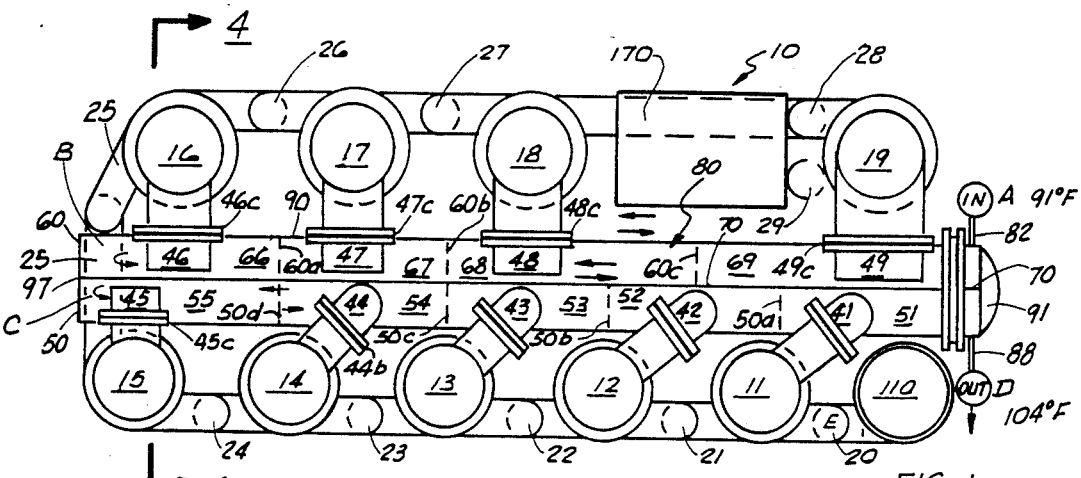
FIG. 1 is a plan view of the preferred embodiment of the apparatus of the present invention.

The preferred embodiment of the single effect multi-stage ("SEMS") flash evaporator of the present invention is best illustrated in FIGS. 1–4 and 7–8 and is designated generally by the numeral 10. Flash evaporator 10 is comprised of multiple modular vertical cyclonic flash chambers 11–19 (for purposes of this specification a 9-stage heat recovery system is provided) that give up their vapor heat to heat recovery condensers 50, 60 where the vapors are condensed to distilled water and pumped to an atmospheric distillate holding tank 170. As best seen in FIG. 1, cyclonic chambers 11–15 are aligned in series on one side of apparatus 10 and are connected by vapor ducts 41–45 respectively to heat recovery condenser 50 and cyclonic chambers 16–19 are aligned in series opposite chambers 11–15 and are connected by vapor ducts 46–49 respectively to heat recovery condenser 60. Heat recovery condensers 50, 60 have common division plate 70.

Cyclonic chambers 11–19 are connected serially with chamber 11 being connected to chamber 12 by piping 21, chamber 12 being connected to chamber 13 by piping 22, chamber 13 being connected to chamber 14 by piping 23 et sequence, with finally chamber 18 being connected to chamber 19 by piping 28. An inlet into the vacuum chamber system 11–19 is provided by piping 20 which enters chamber 11 and an outlet from evaporator system 11–19 is provided by piping 29.

Each of piping systems 21–28 connecting cyclonic flash chambers 11–19 is provided with sealing means or "deep loop" seals 31–38 respectively (36–38 not shown) to prevent "blowby" between stages at all levels of capacity.

Figure 2:
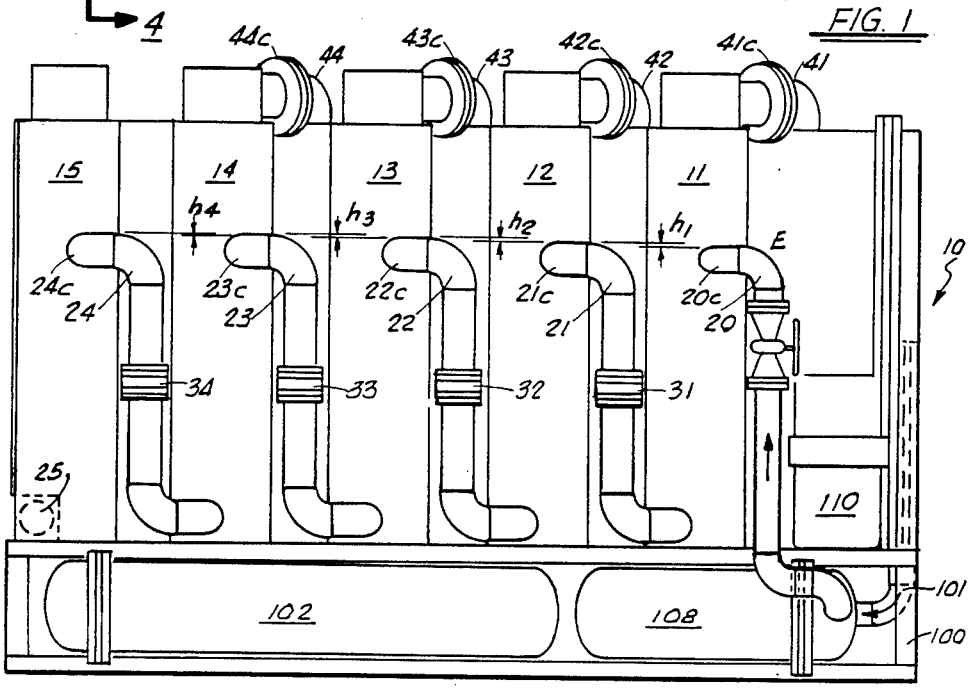
FIG. 2 is a side view of the apparatus of FIG. 1.

As best seen in FIG. 2, piping 21 enters flash chamber 12 at inlet **21*c* at a point slightly above inlet 20*c* where piping 20 enters flash chamber 11, thus creating a height differential h1, the function of which will be described further herein. In a similar manner piping systems 22–28 enter flash chambers 13–19 at inlets 22*c*–28*c* (26*c*–28*c* not shown) such that inlet 22*c* is in a vertical position slightly above inlet 21*c* creating a height differential h2, inlet 23*c* is in a vertical position slightly above inlet 22*c* creating a height differential h3** and so on.

Figure 4:
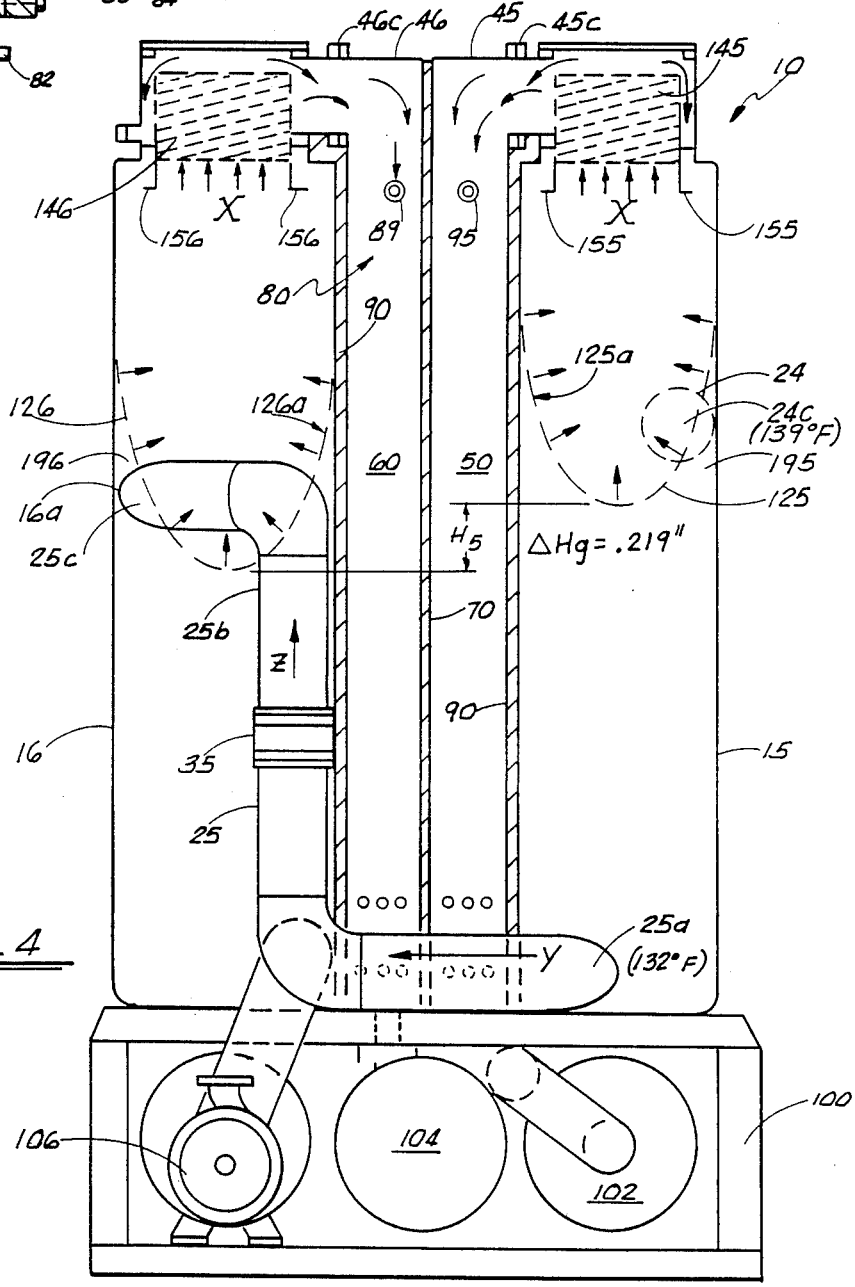
FIG. 4 is a sectional view of the apparatus of FIG. 1 taken along the Line 4—4 of FIG. 1 and illustrating liquid and vapor flow patterns.

As best seen in FIGS. 1, 2 and 4, each of flash chambers 11–19 are connected at their upper ends by vapor ducts 41–49, respectively, to heat recovery condensers 50, 60 with flash chambers 11–15 connected to heat recovery chamber 50 and chambers 16–19 connected to heat recovery chamber 60, the two chambers having common division plate 70. As best seen in FIGS. 1 and 2, vapor ducts 41–49 are provided with sealed expansion joints 41c–49c respectively for purposes to be described further herein.

As best seen in FIG. 1, heat recovery condenser 50 is provided with a series of transverse division plates, 50a–50d, thus creating a series of chambers, 51–55, such that flash chamber 11 is connected to heat recovery condenser 50 at chamber 51 by vapor duct 41, flash chamber 12 is connected to heat recovery condenser 50 at chamber 52 by vapor duct 42, flash chamber 13 is connected to chamber 53 by vapor duct 43, flash chamber 14 is connected to heat recovery condenser chamber 54 by vapor duct 44 and, finally, flash chamber 15 is connected to heat recovery chamber 55 by vapor duct 45. Similarly, chamber 60 is provided with a series of transverse division plates 60a–60c thus creating chambers 66–69, such that each of cyclonic chambers 16–19 are connected by vapor ducts 46–49 to chambers 66–69 respectively of heat recovery condenser 60.

Figure 7:
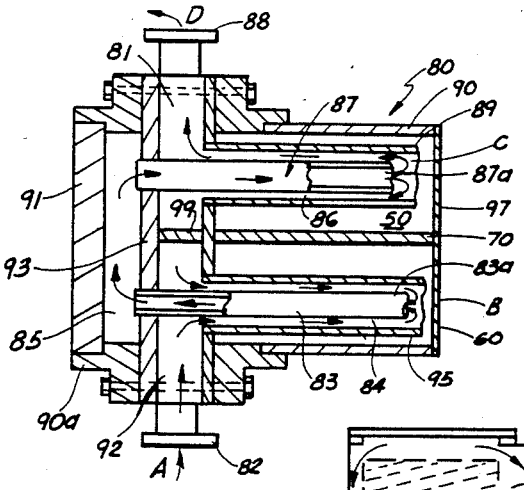
FIG. 7 is an enlarged plan sectional view of a shortened embodiment of the bayonet tube heat exchanger of FIG. 6 of Applicant's co-pending application, Ser. No. 617,760, now U.S. Pat. No. 4,548,257, with a single effect multi-stage ("SEMS") double tube arrangement.
Figure 11:
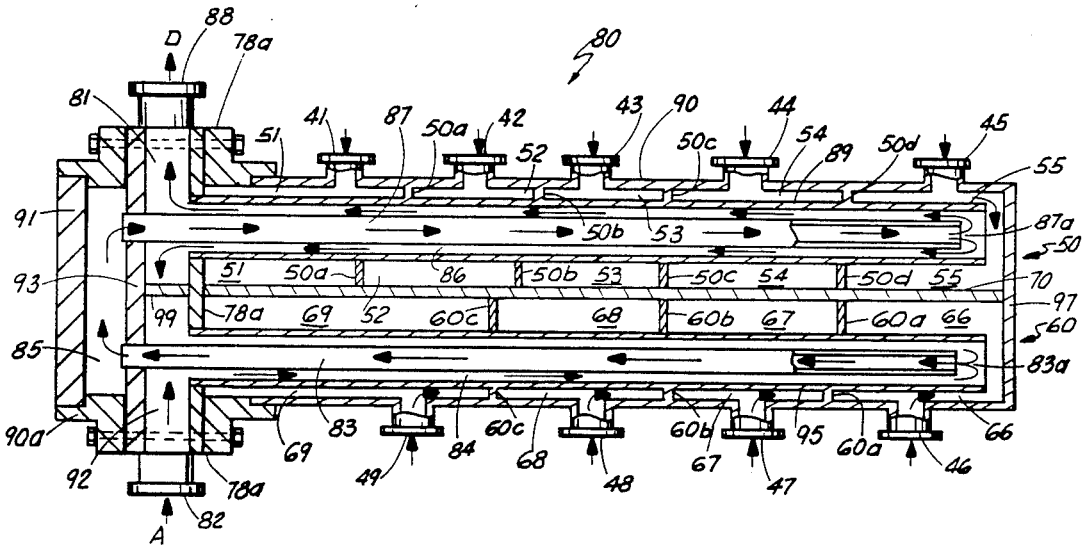

As best seen in FIGS. 4, 7 and 11; heat recovery condensers 50, 60 are provided with at least one longitudinally and horizontally positioned bayonet tube heat exchanger 80 (although several can be arranged over the height of condensers 50,60) such as that taught in Applicant's co-pending application, Ser. No. 617,760 entitled "Bayonet Tube Heat Exchanger" and now U.S. Pat. No. 4,548,257. In FIG. 4 bayonet tube heat exchanger 80 is positioned in the upper portions of condensers 50,60 but the location can selectively vary over the height of condensers 50,60 based on varying operating criteria. As best illustrated in FIG. 7, the apparatus of the present invention 10 would have a modified structure compared to that shown in FIG. 6 of co-pending application Ser. No. 617,760, depicting the multiple bayonet tube heat exchanger. As seen in FIG. 7 and 11, the bayonet tube heat exchanger 80 of the present embodiment has an arrangement wherein insulated plastic bayonet tube 83 and insulated plastic bayonet tube 87 (although a multiple tube arrangement or "bundle" may be used in condensers 50,60) connect to a single chamber or plenum 85, formed by end closure sheet 91, tube sheet 93 and shell section 90a of shell 90, by piercing sheet 93. Thus, fluid entering through inlet 82 and into chamber 92, formed by tube sheet 93 and shell section 90 having end plate 97 (the fluid is blocked from communicating with chamber 81 by division plate 99) and titanium tube sheet 78a (as in FIG. 6 and at Column 15, Line 10 et seq. of parent application Ser. No. 617,760 (now U.S. Pat. No. 4,548,257)); travels into annular passage 84 between bayonet tube 83 and sheath 95, down the passage 84 through chambers 69, 68, 67 and 66, "turns around" at end point 83a (arrows at POINT B) of tube 83, enters tube 83 and exits down the same bayonet tube 83 which is in fluid communication with plenum 85. Fluid entering plenum 85 from bayonet tube 83 exits into bayonet tube 87. This fluid then travels the length of bayonet tube 87, exits tube 87 and "turns around" at end point 87a (POINT C) of bayonet tube 87, and returns through annular passage 86 between bayonet tube 87 and its sheath 89 through chambers 55, 54, 53, 52, and 51, and into chamber 81 and exits heat exchanger 80 through outlet 88 at POINT D. This arrangement increases the water velocities through heat exchanger 80. Such velocities may be further increased by adding additional passes. As illustrated in FIGS. 7 and 11, condensing fluid turbulently flows through annuli 84 and 86 for high heat transfer rates to condensing vapors being swept to the colder inlet fluid in true counter-flow relationship. The sweeping action is important in the removal of non-condensible gases as disclosed in Ser. No. 617,760 (now U.S. Pat. No. 4,548,257). The last chamber 69 is preferably larger than the first chamber 51 to provide additional heat transfer surfaces for the flash chamber 19 (stage 9) over chamber 11 (stage 1) since a greater amount of the non-condensable build up in the higher vacuum chamber 69.

Figure 3:
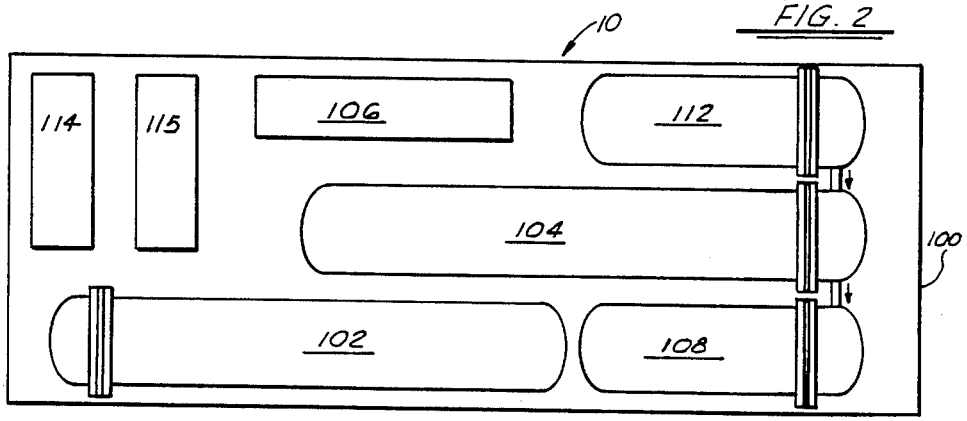
FIG. 3 is a bottom view of the apparatus of FIG. 1.

Flash evaporator 10, as best shown in FIGS. 1–3 is skid-mounted on skid 100. Fluid inlet 101 is provided for introducing heated contaminated water, including sea water, to apparatus 10 via inlet piping 20. Apparatus 10 is further provided with freon chiller 102, freon condenser 104, brine pump 106, waste heat reclaimer 108, freon compressor 110, high and low pressure distillation pumps 114, 115 respectively and a fluid outlet 119, the interconnection and operation of which will all be discussed further herein.

Turning now to FIG. 4 there is illustrated in section cyclonic flash chambers 15, 16 and the focus of the apparatus of the present invention. In the flash evaporation of sea water it has been common practice to introduce sea water at an elevated temperature to a flash chamber defined within an evaporator shell wherein a partial vacuum has been established, the sea water being in excess of the boiling temperature for the vacuum condition present. The vacuum is generally established by connecting the chamber to a vapor condenser and the sea water is generally introduced in prior evaporators to the flash chamber from an elevated inlet so that much of the flashing occurs at or adjacent the inlet opening or nozzle. Frequently, sea water has been introduced in a spray through suitable nozzle means to assist the flashing, but some of the flashing will occur at the surface of the body of sea water established within the evaporator shell. After being exposed to a partial vacuum within the evaporator shell, the sea water is withdrawn from the evaporator through suitable conduit means. In Applicant's U.S. Pat. No. 2,994,647 it was recognized that the parabolic surface of revolution increases the flash area or interface area of the body of water whereby to increase the amount of flashing or volume of vapor derived from this evaporator when compared to a more conventional evaporator of equal shell size. Applicant's '647 patent used a submerged bottom tangential inlet to introduce liquid into the cyclone and spilling over at the top of an inner cylinder and, thus, for a given flow rate the liquid temperature of the spillover or rejected brine more closely approached the vapor temperature resulting in the greatest possible flashing area at the top edge of the static head resulting in high efficiency. However, it has been determined by the Applicant that the cyclone can best be generated by a tangential inlet intermediate the vertical cyclonic chamber whereby the flashing vapors propel the liquid at higher velocities to generate a deeper parabolic surface of revolution to increase the flash area or interface of the body of water thus increasing the amount of flashing or volume of vapor derived from this evaporator when compared to the more conventional evaporators.

Returning now to FIG. 4, fluid enters flash chamber 15 through piping 24 at inlet 24c in two phase (liquid-vapor) flow. The vacuum that the fluid entering at inlet 24c sees desires to change state because it has to go to equilibrium and, therefore, must flash. Thus, the velocity of the vapor increases the speed of the liquid causing the cyclonic effect 195 illustrated by paraboloid of revolution 125 in chamber 15. This change in phase causes the fluid entering through inlet 24c to see lower pressure in chamber 15 than in piping 24 and start to generate steam. The mixture of the liquid and vapor introduced tangentially into chamber 15 at its mid-section enables the vapor and liquid to obtain a higher velocity–on the order of 200 (200 fps) feet per second (cyclonic conditions), to create a deep paraboloid of revolution 125 with parabolic surface of revolution 125a increasing the flash area or interface at the body of water so that a greater area of disengaging surfaces are provided thus increasing the amount of flashing or volume of vapor derived from this chamber. The heavier, cooler liquid settles in chamber 15 and exits through outlet 25a and into piping system 25 for passage in the direction of ARROWS Y and Z to flash chamber 16.

The vapor in cyclonic separator 15 (the fifth flash stage) rises in the direction of ARROWS X and passes through mesh 145 to vapor duct 45 so that only fog particles impinge on mesh 145 and coalesce in a manner so as to eliminate mist. Anti-creep rings 155 are provided in the vapor release area of cyclonic separator 15 to prevent liquid from entering mesh 145 and forces any such liquid back into the liquid cyclone 195 within flash chamber 15. The vapor passing through mesh 145 and vapor duct 45 enters heat recovery condenser 50 where condensation results when it is brought into contact with bayonet tube heat exchanger 80, the operation of which was described above and which will be described further herein.

The fluid which entered chamber 15 at approximately 139° F. (59° C.) has been "flashed down" to 132° F. (56° C.) (as illustrated in the schematic diagram of FIG. 8 which will be discussed further herein) and is provided through piping 25 to be tangentially introduced into chamber 16 at tangential inlet 25c. The loop seal 35 of piping system 25 is clearly depicted in FIG. 4. The "vapor lift" condition which existed upon entry of fluid into flash chamber 15 via piping 24 is recreated in piping 25 at its upper portion 25b where two phase (liquid-vapor) flow develops and reduces the density in the column. The two phase fluid enters chamber 16 at an intermediate point 16a through inlet 25c and in its two phase state flashes to equilibrium increasing the velocity from approximately six (6 fps) feet per second in piping 25 to 200 fps (cyclonic conditions 196) in cyclonic flash chamber 16, the deep paraboloid of revolution 126 presenting a parabolic surface of revolution 126a which provides a greater area of disengaging surfaces and increases the flash of the vapor thus reducing the temperature of the liquid to approximately 125° F. (52° C.) at which it exits flash chamber 16 via piping 26 to flash chamber 17 for further flashing down. As was the case with flash chamber 15, flash chamber 16 is provided with anti-creep rings 156 ("Webre Lips") in the vapor release area which prevent liquid from entering mesh 146 as vapor passes in the direction of ARROWS X into vapor duct 46 and then heat recovery condenser 60 having bayonet tube heat exchanger 80, the operation of which was described above and will be further discussed herein.

As discussed hereinabove, FIG. 4 illustrates the effective placement of inlets 21c–29c in producing the efficient flash effect herein described. Inlet 24c of flash chamber 15 is located a distance h5 above inlet 25c of flash chamber 16 providing a pressure head which drives the liquid through apparatus 10 and generates the cyclones 191–199 (for illustration purposes h5 is depicted as the height differential between the respective minimums of the paraboloids of revolution 125, 126). In stages 5 and 6 in chambers 15 and 16 with fluid entering flash chamber 15 at approximately 139° F. (59° C.) and exiting the chamber at approximately 132° F. (56° C.) at which it enters flash chamber 16 and exits there at approximately 125° F. (52° C.), it takes an approximate four (4") inch (10.2 cm) liquid level difference between chambers 15 and 16 to create a 1" (2.54 cm) Δ Hg pressure head to drive the liquid to generate cyclone 196 in chamber 16. (For example, stage 5 with vapor at 130° F. (54° C.)) and 4.525" (11.5 cm) Hg and stage 6 with vapor at 123° F. (51° C.) and 3.744" Hg creates a 0.781" (1.98 cm) Δ Hg pressure head; a 0.219" (0.56 cm) Δ Hg liquid level differential h5 (1"–0.781" or 2.54 cm –1.98 cm) between chambers 15 and 16 is required to attain the 1" (2.54 cm) Δ Hg head). At lower temperatures a greater liquid level differential is needed to provide this same 1" (2.54 cm) Δ g pressure head and at higher temperatures a smaller differential is needed. Thus, at the relatively higher temperature stages in flash chambers 11, 12 and 13 the liquid level differential, and thus the height spacings h1, h2, h3, between inlets 20c–21c, 21c–22c and 22c–23c respectively of those flash evaporators will be relatively small (under four (4") inches (10.2 cm) as best depicted by FIG. 2), while the spacings h7, h8 and h9 (not shown) between inlets 26c–27c, 27c–28c and 28c–29c respectively of those lower temperature flash chambers 17, 18 and 19 will be greater. The stepdown gravitational effect, in summary, requires less liquid level difference in consecutive flash chambers to drive the liquid as the temperature of liquid introduced thereinto is increased.

Figure 8:
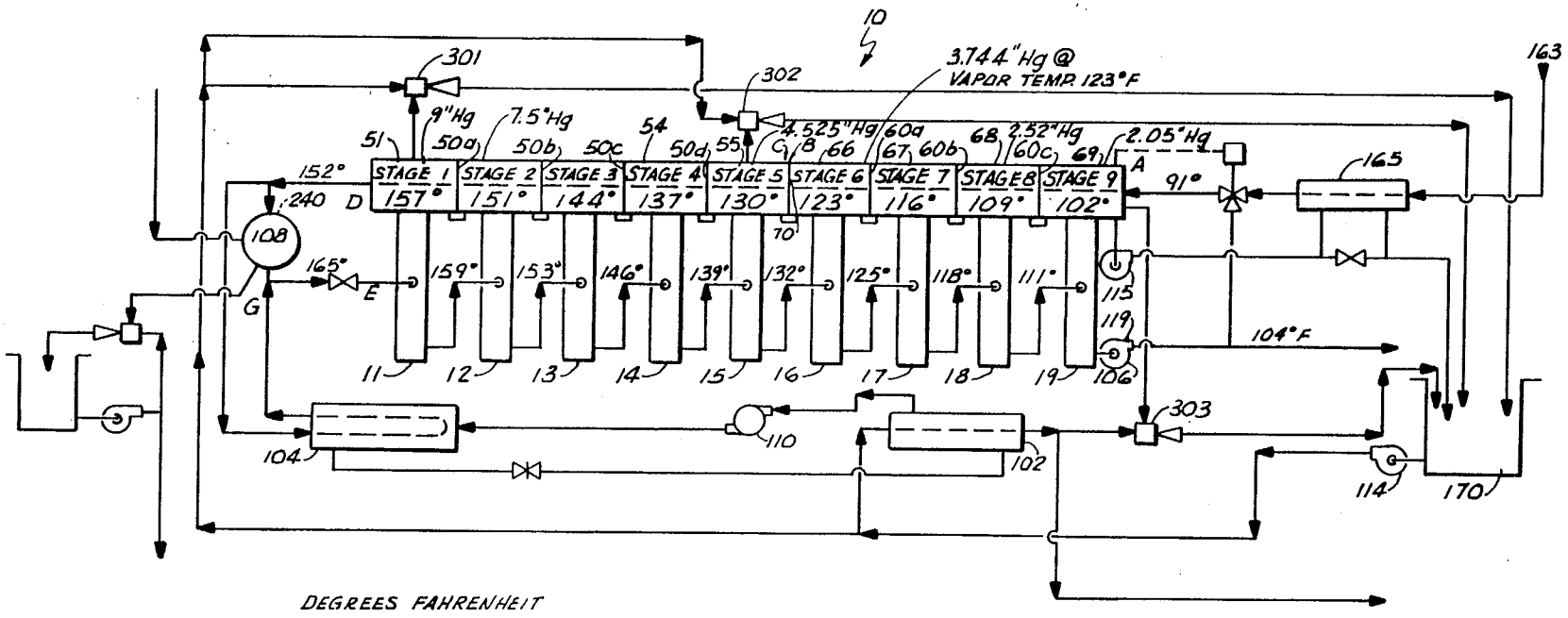
FIG. 8 is a schematic illustration of a single effect multi-stage ("SEMS") heat pump distiller coupled with waste heat from a diesel generator.

Turning now to FIG. 8 in conjunction with FIGS. 1–4 and 7, the operation of the preferred application of the apparatus of the present invention 10 (open loop system) is best understood. Contaminated water, such as sea water, is provided from source 163 and passes through a distillate cooler 165 where at POINT A it is introduced into heat recovery condenser 60 at approximately 91° F. (33° C.) at inlet 82 of bayonet tube heat exchanger 80 and passes through plenum 92 and enters the annulus 84 formed between bayonet tube 83 and its sheath 95 where it will flow through chamber 69 of heat recovery condenser 60 where the heat added by the flashing vapors at 102° F. (39° C.) and 2.05" (5.21 cm) Hg in cyclonic chamber 19 increases the liquid temperature to 98° F. (37° C.) (The water at 91° F. (33° C.) sees vapors at 102° F. (39° C.) and increases in temperature 7° F. (4° C.) because the vapor flashes down 7° F. (4° C.) from 111° F. (44° C.) to 104° F. (40° C.). The fluid proceeds down annulus 84 where it is successively heated by the flashing vapors in chambers 68, 67 and 66 from 98° F. (37° C.) to 105° F. (41° C.) to 112° F. (44° C.) to 119° F. (48° C.). At POINT B of FIGS. 1, 7, 8 and 11 fluid has reached the end of bayonet tube 83 and has "turned around" and is passing back down insulated bayonet tube 83 inside thereof and is returned to plenum 85 where it enters into bayonet tube 87. In heat recovery condenser 50 on the opposing side of common dividing wall 70 the heated fluid passes down insulated bayonet tube 87 and exits at its end point 87a or POINT C and "turns around" and passes back down the annulus 86 between sheath 89 and bayonet tube 87 where it interfaces in chamber 55 with the vapor at 130° F. (54° C.) and 4.525" (11.49 cm) Hg exiting from flash chamber 15 which heats the liquid from 119° F. (48° C.) to 126° F. (52° C.). Serially, the fluid passes through chambers 54, 53, 52 and 51 where it is heated progressively from 126° F. (52° C.) to 130° F. (54° C.), 140° F. (60° C.), 146° F. (63° C.) and 152° F. (67° C.) as it exits chamber 51 and into plenum 81. The fluid exits heat recovery condenser 50 at outlet 88 which is connected in parallel to waste heat reclaimer 108 (at inlet 101 thereof) and to FREON condenser 104 where it is heated by waste heat fluid in reclaimer 108 and by FREON in condenser 104 After the heated fluid is again mixed (at POINT G of FIG. 8) at approximately 165° F. (74° C.), it is passed via piping 20 into flash chamber 11 where it begins the nine (9) stage flashing cycle described above with respect to flash chambers 15, 16 at stages 5 and 6.

Returning now to FIG. 8, the schematic illustration of the flashing begins at POINT E with the fluid entering flash chamber 11 at approximately 165° F. (74° C.) (after being heated in reclaimer 108 and FREON condenser 104). The liquid in chamber 11 flashes down to approximately 159° F. (71° C.) (The 6° F. (3° C.) flash down corresponding to the rise in vapor temperature from 151° F. (66° C.) to 157° F. (69° C.)). As the fluid exits flash chamber 11 via piping 21 the pressure head created due to the height differential between inlet 20c of chamber 11 and inlet 21c of chamber 12 drives the cyclone 192 (not shown) in flash chamber 12 causing flashing from the 159° F. (71° C.) entry temperature to 153° F. (67° C.) exit temperature. In a similar manner flashing in cyclonic flash chambers 13–19 causes reduction in the temperature from 153° F. (67° C.) in flash chamber 12 to 146° F. (63° C.) in flash chamber 13, to 139° F. (59° C.) in flash chamber 14, to 132° F. (56° C.) in flash chamber 15, to 125° F. (52° C.) in flash chamber 16, to 118° F. (48° C.) in flash chamber 17, to 111° F. (44° C.) in flash chamber 18, to 104° F. (40° C.) in flash chamber 19 and an exit temperature of 104° F. (40° C.) at outlet 119 at the discharge (illustrated in FIG. 8) at brine pump 106 which feeds the distilled liquid to distillate tank 170. Thus, it can be understood that with the liquid flashing down approximately 6° F. to 7° F. (3.3° C. to 3.9° C.) in each of cyclonic separators 11–19, vapors at approximately 600,000 pounds of liquid per hour will produce 36,000 pounds of steam per hour with the regenerative heating of apparatus 10 (600,000 pounds of liquid at 165° F. (74° C.) in chamber 11 exits chamber 19 at 104° F. (40° C.) a flash down of 61° F. (34° C.); thus with 36,600,000 BTUs at an average latent heat of vaporization of 1,016 at high vacuum, 36,000 pounds of steam are produced per hour). Further, with the use of the bayonet tube heat exchanger 80 of Applicant's co-pending application, Ser. No. 617,760, now U.S. Pat. No. 4,548,257, adapted as illustrated in FIG. 7, there is but one (1) inlet and one (1) outlet loss in the heat recovery condensers 50,60 and not nine (9) such inlet and outlet losses.

In the preferred application of the apparatus of present invention 10, any source of contaminated water 163, including sea water, can be used. If the source supply is limited it can be recycled over a cooling tower to dissipate the waste heat recovery. The source water 163 is pumped or "vacuum dragged" through the heat recovery condensers 50, 60–in this case the nine (9) stage flash system 11–19 where the temperature is raised from 91° F. (33° C.) to about 152° F. (67° C.) from where it will pass through FREON condenser 104 picking up the heat from the heat pump 114 and also through the diesel waste heat reclaimer 108 to raise the inlet temperature of the first stage of the flash cycle or flash chamber 11 to 165° F. (74° C.). The contaminated water flashes down through the nine (9) cyclonic flash chambers 11–19 giving up its vapor heat to the heat recovery condensers 50, 60 where the vapors are condensed to distilled water and pumped to an atmospheric distillate holding tank 170. The exiting "brine" at 104° F. (40° C.) or distillate at 102° F. (39° C.) can serve as the heat source for FREON compressor or heat pump 110 and is pumped through FREON chiller 102 cooling the brine or distillate to about 95° F. (35° C.) before being discharged. In an alternate application, such as that illustrated in FIG. 9, a cooling tower 402 in a closed loop system can serve to recycle the fluid to be evaporated so that a high degree of brine concentrate can be acquired.

Another unique feature of apparatus 10 of the present invention illustrated in FIG. 8 is the use of multiple hydraulic ejectors 301–303 to remove non-condensibles from the heat recovery condensers 50, 60. The ejectors 301–303 are powered by high pressure distillate transfer pumps at a pressure in excess of three (3 atm) atmospheres (45 psig). Ejectors 302 on the fifth stage and 301 on the first stage remove any residual entrainment plus infiltration, and the last ejector 303 cleans up any additional infiltration, as well as removal of the made distillate. The high transfer rates acquired with the Applicant's patented bayonet augmented tube (BAT) heat exchanger 80 is in part attributable to this efficient gas removal. The BAT heat exchanger 80 provides many advantages over long tube or cross flow flash designs. It has enabled the us of light gauge titanium sheaths in reasonably large tube diameters at costs no greater than conventional "U" tube copper-nickel designs. In these relatively small capacities, the conventional long tube fixed tube design "draws itself to death" since it would require very small tube diameters to pack in the required surfaces and attain acceptable liquid velocities. The cross flow design expands pumping energy in many entrance and exit losses. The BAT heat exchanger long tube design with only two (2) entrances and exits allows the expenditure of equivalent pressure losses in the high turbulent flow of the annulus, such as annuli 84, 86 of the present invention, for greater heat transfer rates. The conventional bayonet tube designs if applied to a long tube evaporator would solve the expansion problem but would require considerable extra surface because of the reheat problem. The heavy-walled CPVC (co-polyvinylchloride) insulated plastic bayonet tubes (83, 87) resolve this reheat problem. Their relatively large diameter enables the use of large diameter titanium sheaths (89, 95) reducing the number of holes to drill.

With the advent of the compact BAT heat exchanger as disclosed in Applicant's co-pending application, Ser. No. 617,760, now U.S. Pat. No. 4,548,257, the Applicant needed a compact flash chamber with high release rates, hence, cyclonic flash chambers 11–19 illustrated in FIGS. 1–4. The cyclone (191–199) generates a paraboloid of revolution (121–129) providing a large release surface area (areas **121*a*–129*a*) and vertical chambers provide good loop seals (31–39**) between stages to prevent blowby under different operating conditions. In summary, a nine stage 12,000 gallon per day plant will occupy a space of about four (4') feet (1.22 m) wide by ten (10') feet (3.05 m), six (6") inches (15.24 cm) long by seven (7') feet (2.13 m) high; a 100,000 gallon per day plant in a space of eleven (11") inches (27.94 cm) wide by twenty (20') feet (6.1 m) long by eight and one-half (8½') feet (2.6 m) high.

Figure 5:
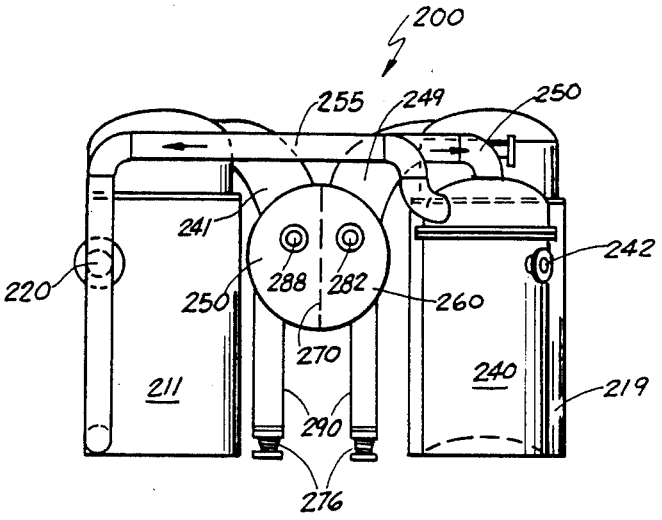
FIG. 5 is an end view of an alternate embodiment of the apparatus of FIG. 1.
Figure 6:
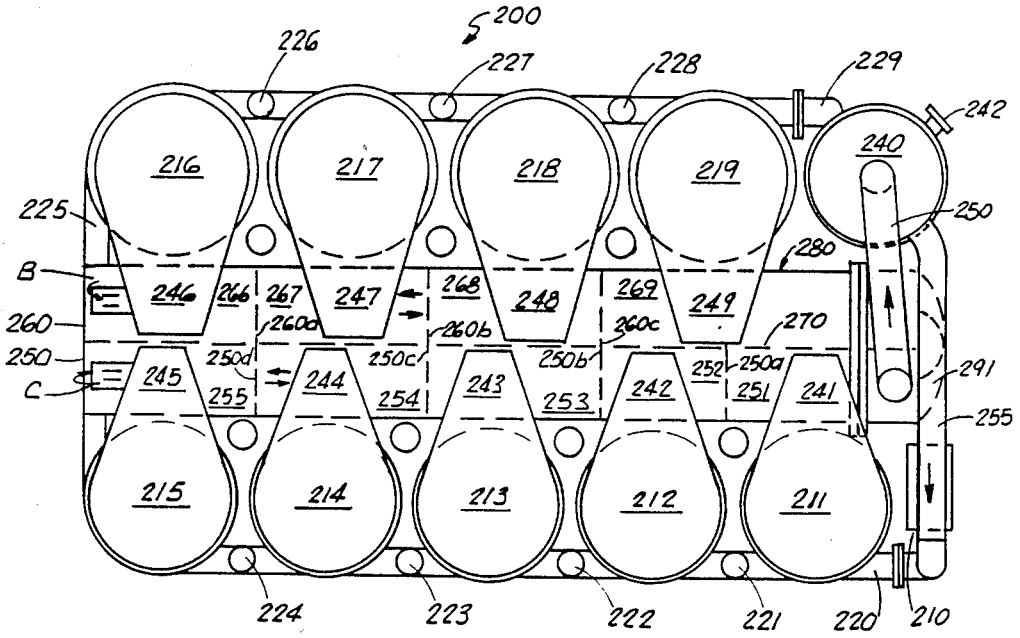
FIG. 6 is a plan view of the alternate embodiment of the apparatus of the present invention of FIG. 5.

An alternate embodiment 200 of the present invention is depicted in FIGS. 5 and 6 having serially connected cyclonic chambers 211–215, 216–219 connected to semi-cylindrical heat recovery condensers 250,260 (joined at common division plate 270 to form a cylindrical unit and having bayonet tube heat exchanger 280) respectively by vapor ducts 241–245, 246–249 in much the same manner as apparatus 10. Also, piping system 220–229, 250, 255, closure sheet 291 and FREON compressor 210 are provided in much the same manner as apparatus 10. As best seen in FIGS. 5 and 6 (and also schematically in FIG. 8), contaminated water is fed to bayonet tube heat exchanger 280 via inlet 282 to begin the regenerative heating process passing through chambers 269, 268, 267, 266, 255, 254, 253, 252 and 251 created by division plates **250*a–d* and 260*a–c* and division plate 270. Upon completion of the heating in heat exchanger 280, the fluid exiting at outlet 288 is passed through piping 250 to sea feed heater 240 (replacing waste heat reclaimer 108 of the preferred embodiment 10 which is supplied with steam through inlet 242) to raise the temperature before entering piping system 220 to begin the flash cycle 211–219 as described above. The cylindrical unit formed by heat recovery condensers 250,260 is mounted on supports 290 which are provided with shock mounts 276 in the alternate embodiment of FIGS. 5 and 6**.

Figure 9:
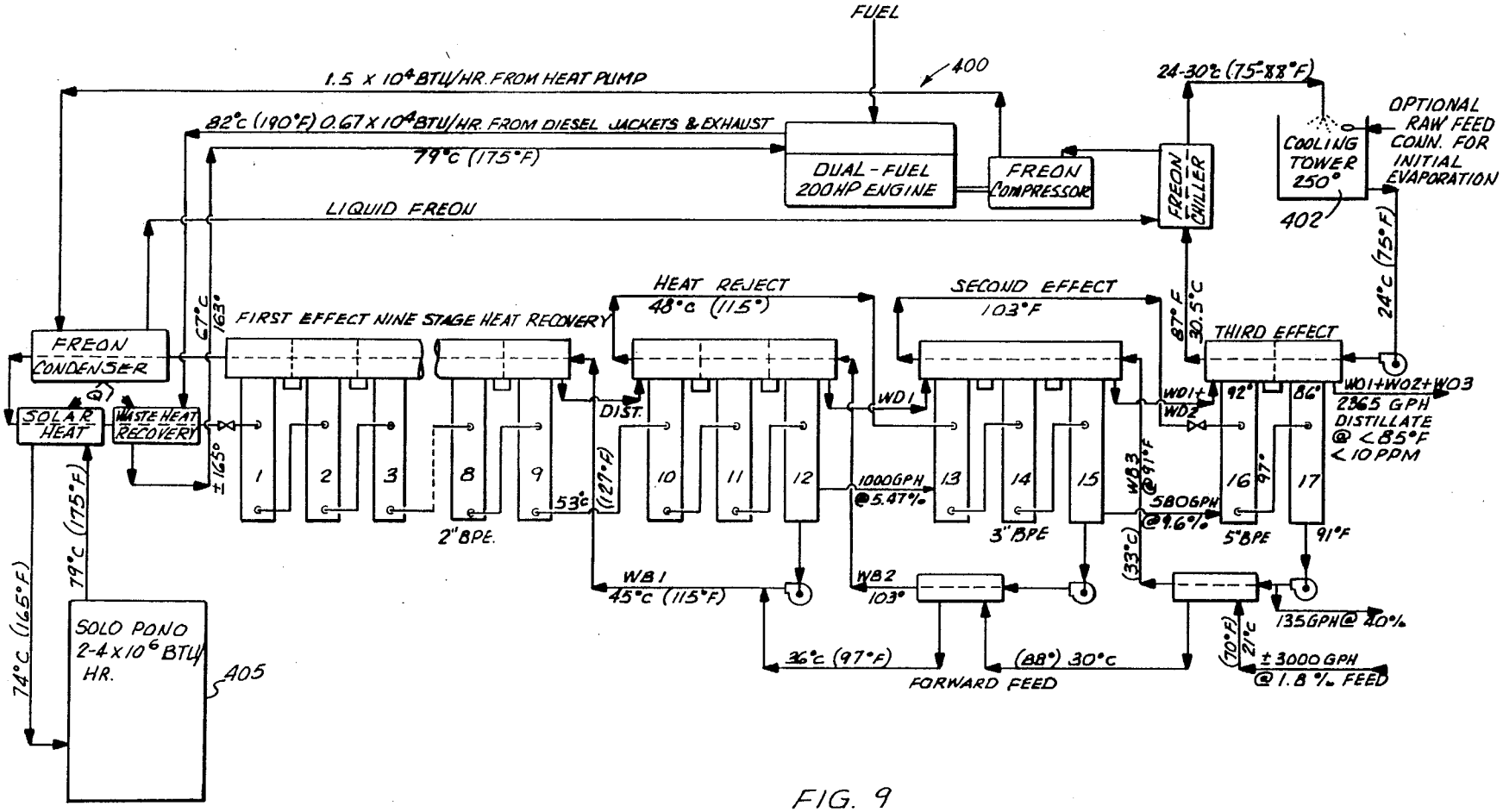
FIG. 9 is a schematic illustration of a multi-effect multi-stage ("MEMS") arrangement employing a solar pond and heat pump for the concentration of industrial waste.

The apparatus of the present invention 10 can be readily applied to a multi-effect, multi-stage (MEMS) cycle as described in "Heat Pump Distiller/Concentrator" published by W. R. Williamson, et al. in the Water Supply Improvement Association (WSIA) 12th Annual Conference Technical Proceedings, Vol. I, Sessions I–VI, May 1985 and references cited therein. FIG. 9 shows a closed loop MEMS arrangement 400 employing a solar pond 405, cooling tower 402 (for recycling) and heat pump for the concentration of industrial waste. A paper entitled "Desalination", Volume IV, No. 3 1968 by Fan, L. T., et al. referred to in "Heat Pump Distiller/Concentrator" discussed above provides an in-depth study of some of the thermodynamic calculations involved with the MEMS cycle.

Figure 10:
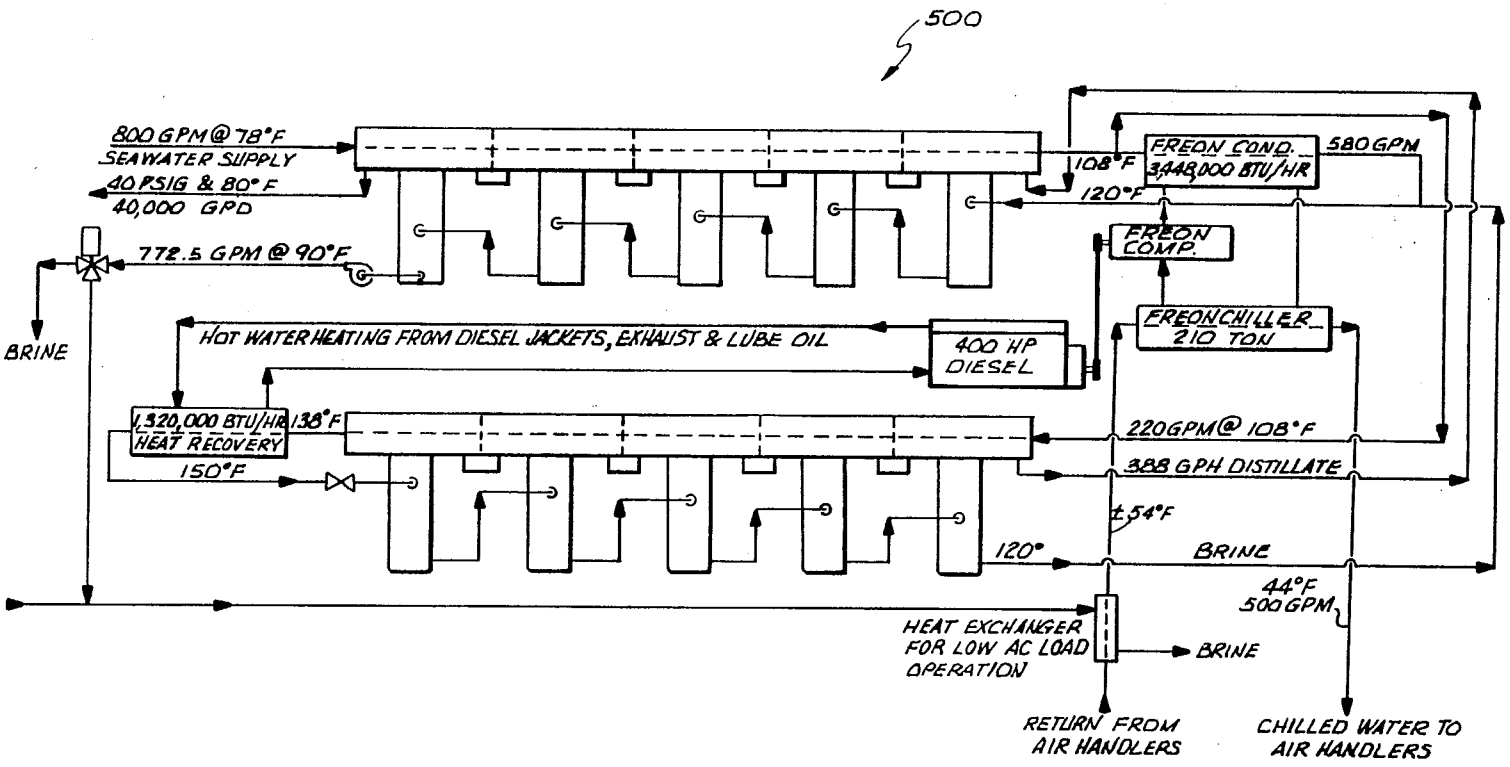
FIG. 10 is a schematic illustration of how 200 gallons/day can be produced from the waste heat of a ton of air conditioning; and, FIG. 11 is a full enlarged plan sectional view of the embodiment of the bayonet tube heat exchanger of FIG. 7.
Figure 12A:
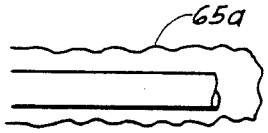
FIG. 12A is an enlarged sectional view of the distal end of the single bayonet tube heat exchanger of FIG. 4 of parent U.S. Pat. No. 4,548,257 having a spirally sheath; and, FIG. 12B is an enlarged sectional view of the distal end of the single bayonet tube heat exchanger of FIG. 4 of parent U.S. Pat. No. 4,548,257 having an externally finned and internally spirally grooved sheath.
Figure 12B:
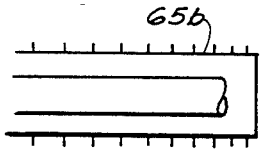

FIG. 10 shows an arrangement 500 where it is disclosed how 200 gallons of pure water per day can be produced from the waste heat of a ton of air conditioning. Based upon the average cost of power and water the payback period is considerably short. As disclosed in parent U.S. Pat. No. 4,548,257 teaching the bayonet tube heat exchanger, the FREON condenser of the heat pump can employ the bayonet tube heat exchanger using enhanced tubing for the sheath. Finned or twisted tubes **65*a*, 65*b* as illustrated in FIGS 12A and 12B** respectively, similar to those described in U.S. Pat. No. 3,533,267 can be used to condense the FREON vapors on the outside of the sheath and transfer heat to distilled water, or other liquid to be heated, in the annulus between the sheath and the insulating bayonet. Such sheaths are commercially available under the KORODENSE ® and TURBO-CHIL ® trademarks.

Other areas that may consider the application of this technology are: replacing evaporation ponds, radioactive waste concentrators, cooling tower blowdown concentrators, food processing concentrators, mining slurry concentration, drill rig water supply and concentration of waste, recycling water for washing smokestacks and concentrating and recovering the acid (acid rain).

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense. The invention is to be limited only by the scope of the claims appended hereto.

What is claimed as invention is:

1. A FREON heat pump having a FREON condenser, said condenser including:

a. a substantially horizontal outer shell having an elongated center section, and having a first tube sheet closure a closed distal end;

b. at least one externally finned tubular sheath member having a closed end adjacent but spaced from said closed distal end of said shell and an open end facing said first tube sheet closure of said shell;

c. means for forming a first fluid flow zone between the outer surfaces of said finned sheath and said shell wherein said first fluid is condensed;

d. an insulating plastic bayonet tube concentrically positioned in at least one of said sheaths, said bayonet tube piercing said first tube sheet closure, and having an outer portion extending at least through said first tube sheet closure and an inner portion terminating in an open end space from said closed end of said sheath;

e. means for forming a second fluid flow zone wherein said second fluid is heated in turbulent flow, said second fluid flow zone including the annulus formed between said bayonet tube and the inner surface of said sheath;

f. means for directing said second fluid into said bayonet tube in the direction of said open end of said bayonet tube; and g. means for removing said heated second fluid from said second fluid flow zone.

2. The apparatus according to claim 1 further comprising means for directing said second fluid into said annulus in the direction of said open end of said bayonet tube.

3. A FREON heat pump comprising:

a. a FREON compressor; and b. a FREON chiller including:

i. a substantially horizontal outer shell having elongated center section, an inner end having a first tube sheet closure and a closed distal end;

ii. at least one externally finned tubular sheath having a closed end adjacent but spaced from said closed distal end of said shell and an open end facing said first tube sheet closure of said shell;

iii. means for forming a first fluid flow zone between the outer surfaces of said sheath and said shell wherein said first fluid is cooled;

iv. a small diameter bayonet tube concentrically positioned in at least one of said sheaths, said bayonet tube piercing said first tube sheet closure, and having an outer portion extending at least through said first tube sheet closure and an inner portion terminating in an open end spaced from the closed end of said sheath;

v. means for forming a second fluid flow zone between said bayonet tube and the inner surface of said externally finned tubular sheath;

vi. means for forming a second fluid flow zone wherein said second fluid is heated in turbulent flow, said second fluid flow zone including the annulus formed between the bayonet tube and the inner surface of said externally finned tubular sheath;

vii. means for directing said second fluid into said bayonet tube in the direction of said open end of said bayonet tube; and viii. means for removing said second fluid from said second fluid flow zone.

4. The apparatus according to claim 3 further comprising means for directing said second fluid into said annulus in the direction of said open end of said bayonet tube.

* * * * *